US007526815B1

(12) United States Patent
Kelly

(10) Patent No.: US 7,526,815 B1
(45) Date of Patent: May 5, 2009

(54) BABY BIB WITH PROTECTIVE NECKLINE

(75) Inventor: Shea Kelly, San Mateo, CA (US)

(73) Assignee: Chez Shea Baby, LLC, San Mateo, CA (US)

( * ) Notice: Subject to any disclaimer, the term of this patent is extended or adjusted under 35 U.S.C. 154(b) by 0 days.

(21) Appl. No.: 12/069,066

(22) Filed: Feb. 6, 2008

Related U.S. Application Data

(63) Continuation-in-part of application No. 11/705,999, filed on Feb. 13, 2007, now Pat. No. 7,448,089.

(60) Provisional application No. 60/810,482, filed on Jun. 2, 2006.

(51) Int. Cl.
*A41B 13/10* (2006.01)

(52) U.S. Cl. ..... 2/49.1; 2/49.2; 2/52

(58) Field of Classification Search ..... 2/49.1–49.5, 2/51, 52, 50, 48, 46, 468, 75, 80, 88, 129–136, 2/139, 141.1, 207, 174, 206, 111, 91, 92, 2/103, 140, 143; D2/602, 603, 604, 860–864
See application file for complete search history.

(56) References Cited

U.S. PATENT DOCUMENTS

| | | | | | |
|---|---|---|---|---|---|
| 1,548,830 | A | | 8/1925 | Dunsworth | |
| D97,457 | S | * | 11/1935 | Bernstein et al. | D2/604 |
| D97,458 | S | * | 11/1935 | Bernstein et al. | D2/604 |
| 2,114,922 | A | * | 4/1938 | Glasmann | 2/48 |
| 2,246,035 | A | | 6/1941 | Eilliot | 2/50 |
| D141,659 | S | * | 6/1945 | Carpenter | D2/501 |
| 2,423,002 | A | | 6/1947 | Bray | 2/52 |
| 2,501,010 | A | | 3/1950 | Seidenbaum | 2/49 |
| 2,552,462 | A | * | 5/1951 | Savrin | 2/49.2 |
| D166,915 | S | * | 6/1952 | Iwaniec | D2/501 |
| 2,620,475 | A | * | 12/1952 | Legg et al. | 2/50 |
| 2,622,246 | A | | 12/1952 | Hufnagel | 2/49 |
| 2,879,514 | A | | 3/1959 | Shapiro | 2/48 |
| 4,025,961 | A | | 5/1977 | Peters | 2/88 |
| 4,458,364 | A | * | 7/1984 | Fenninger et al. | 2/50 |
| 4,601,065 | A | * | 7/1986 | Sigl et al. | 2/49.2 |
| 4,620,323 | A | * | 11/1986 | Tepper | 2/49.4 |
| 4,660,226 | A | * | 4/1987 | Quilling et al. | 2/49.2 |
| 4,733,411 | A | | 3/1988 | Foti | 2/49 |

(Continued)

FOREIGN PATENT DOCUMENTS

| | | |
|---|---|---|
| WO | WO 2004/041009 A1 | 5/2004 |

(Continued)

*Primary Examiner*—Amy B Vanatta
(74) *Attorney, Agent, or Firm*—Haverstock & Owens LLP

(57) ABSTRACT

A baby bib with a protective neckline is disclosed. The bib protects the baby's clothes and skin from spilled food. A protective neck strap scrunches under a child's neck to ensure that the neckline is adequately covered and protected from food and liquid spilled or drooled out of a baby's mouth when feeding. A rear-affixed pocket is sometimes employed and is configured to be turned inside-out onto the front of the bib, forming a pouch. Back straps secure the bib to the torso of the baby. The bib is removed without moving or disturbing the baby. The bib is constructed from either waterproof and washable materials or disposable materials. Other features include various accessories such as pockets and tear-off attachments and a fastening system.

20 Claims, 9 Drawing Sheets

U.S. PATENT DOCUMENTS

| | | | | | |
|---|---|---|---|---|---|
| 4,779,288 | A | * | 10/1988 | Mack | 2/49.3 |
| 4,975,982 | A | * | 12/1990 | Hughes | 2/49.1 |
| D341,472 | S | * | 11/1993 | Watson | D2/862 |
| D366,556 | S | * | 1/1996 | Wilson | D2/861 |
| 5,819,314 | A | | 10/1998 | Jakson | 2/49.2 |
| 6,000,056 | A | | 12/1999 | Brady et al. | 2/49.1 |
| 6,237,150 | B1 | * | 5/2001 | Lucas | 2/49.1 |
| 6,532,596 | B1 | * | 3/2003 | Fosmo | 2/49.1 |
| 6,859,938 | B1 | * | 3/2005 | Niski et al. | 2/49.1 |
| 2001/0047532 | A1 | * | 12/2001 | Marrero | 2/49.1 |
| 2007/0199123 | A1 | | 8/2007 | Friedland et al. | 2/49.1 |
| 2007/0220651 | A1 | * | 9/2007 | Friedland et al. | 2/49.1 |
| 2007/0250979 | A1 | | 11/2007 | Han | 2/49.1 |

FOREIGN PATENT DOCUMENTS

| | | | |
|---|---|---|---|
| WO | WO 2005053446 | A1 * | 6/2005 |

* cited by examiner

BABY BIB WITH PROTECTIVE NECKLINE

RELATED APPLICATIONS

This patent application is a continuation in part of U.S. patent application Ser. No. 11/705,999, filed Feb. 13, 2007 now U.S. Pat. No. 7,448,089, entitled "BABY BIB WITH PROTECTIVE NECKLINE", which claims priority to U.S. Provisional Patent Application 60/810,482, filed on Jun. 2, 2006, and entitled "BABY BIB WITH PROTECTIVE NECKLINE" to the same inventor, both of which are hereby incorporated by reference in their entirety.

FIELD OF THE INVENTION

The present invention relates generally to baby bibs. More specifically, the invention relates to protective bibs worn around a baby's neck protecting the baby's skin and clothes from food and liquid during feeding.

BACKGROUND

Protective bibs have long been available to protect a baby's clothing from spilled food and liquid during feeding. The basic configuration of a bib is a piece of material covering the baby's chest with some means for attaching or securing the bib to the child. Various attachment means have been used.

One common configuration is a bib with a clothing protective front panel and two extending flaps which extend up to the child's shoulders and around its neck. The two extending flaps are then secured behind the baby's neck by some securing means. Common securing means include a tie string, buttons or a pair of patches of hook and loop fasteners, such as Velcro. Because the securing means are located at the back of the baby's neck, the person applying the bib can either see the securing means or the tightness of the bib around the baby's neck, but not both. Numerous problems arise when using these configurations.

First, a dangling tie string is an attractive nuisance which presents a hazard for a child. Infants grab and play with anything they can reach. When using a tie-string bib, infants pull their bibs lose as soon as they can get their hands on the string. Also, a baby can inadvertently get their bib wrapped around an arm of a high chair or some other protrusion resulting in the string being pulled tight around the baby's neck and the child being injured.

Second, when such a bib is secured with buttons, snaps or fasteners, the tightness of the bib cannot be adjusted beyond the geometry of the securing means. As such, the tightness of the bib cannot be personally tailored, resulting in either a choking hazard when the bib is too tight or a spill hazard when the bib is too loose.

A bib that is too loose around a baby's neck is a considerable and frequent problem. A loose bib allows food and liquid to be spilled onto the baby's skin or clothes. It is especially problematic when liquid drips into a baby's neckline where a newborn may have folds of sensitive skin. When liquid is in contact with a baby's sensitive skin for a prolonged period of time, the baby is likely to develop a rash which is able to irritate an infant.

Also, no matter what securing means is used, children are often irritated with wearing a bib, and they will pull at any accessible part of the bib. The above configurations allow the child to either remove their bibs by tugging, to tighten them to a dangerous level by pulling the tie rope, or to tighten them so that the bib is difficult to untie.

Furthermore, bibs with flaps and an around the neck securing means are difficult to remove from a sleeping baby. It is most desirable to remove the soiled and wet bib immediately after a feeding to prevent the baby from getting wet, dirty and cold. Children, especially infants, often fall asleep after feeding. Bibs configured to only be removable from the back requires a caregiver to lift the baby's head, reach around the child, fumble with the securing means, remove the bib and move their child back into a comfortable position. Such maneuvering often times wakes up and irritates the baby.

Another common configuration is an "over the head" bib. An "over the head" configuration is a simple and common bib design. This configuration has major drawbacks. First, the "over the head" bib must be manufactured to be one-size-fits-all, and is therefore not customizable to fit a particular baby. Furthermore, to be comfortably placed over the head of a baby, the opening in the "over the head" bib must be larger than the baby's head and their delicate facial features. The result of this need for a large opening is that the bib will never be comfortably secure around a baby's neck, or perhaps even their upper chest. The problem with removal of this type of bib is even more problematic as with the previous configuration, and waking or disturbing a sleeping baby is almost inevitable.

Parents and caregivers spend considerable money on baby clothing, and considerable time changing and laundering the baby's clothing. Given the inefficiency of the bibs described in protecting the clothing during feeding, clothing not only gets wet but often stained, defeating the primary protection purpose of the bib. It also leads to more frequent clothing changes than would be necessary with an efficient bib, and a corresponding increase in laundering the clothing, not to mention unnecessary discomfort to the child.

Another problem associated with traditional bibs is that babies grow quickly and tend to grow out of their bibs. This problem is compounded if an attempt is made to procure a bib that fits well enough to adequately protect the child's neck. Since such a bib should cover the baby's neckline, a small amount of growth will render the bib too tight and useless.

Furthermore, parents and caregivers will feed an infant multiple times each day, especially in the child's earliest stages in which feedings occur as many as 10-12 times per day, with much of those times in the middle of the night. As such, the irritation associated with common bibs listed above are compounded after numerous occurrences. Also, using inefficient bibs, which do not protect the baby's skin, especially the neckline, can lead to significant frustration on the part of the feeder and results in skin irritation on the part of the child.

An additional problem associated with traditional bibs is found in the use of front-affixed pockets with the intended use of catching dropped or spilled articles such as food, liquid, etc. Most commonly such pockets are ineffective because they are tightly stitched to the front panel of the bib and do not protrude to catch items. Furthermore, debris actually caught in front-affixed pockets is difficult to clean out of the pocket. The debris commonly gets lodged into the creases and corners of the pockets and is not removed when laundered, causing unpleasant and unsanitary conditions.

SUMMARY OF THE DISCLOSURE

The present invention is a baby bib with a protective neckline. The bib has a body section with a protection panel for protecting the baby's clothes and skin from spilled food. The bib also has shoulder straps and a protective neck strap to secure the bib around the baby's neck. The protective neck strap scrunches under a child's neck to ensure that the neckline is adequately covered and protected from food and liquid spilled or drooled out of a baby's mouth when feeding. The protective scrunch neck also allows the bib's size to be customizable and adaptable. In some embodiments of the present invention a parent or caregiver is able to remove the bib without moving or disturbing the baby. In some embodiments one protective neckline strap secures the bib. In other embodiments, two straps are used to secure the bib. In some embodiments of the present invention the baby bib is constructed from waterproof or water resistant materials. In some embodiments the baby bib is constructed from washable materials. In other embodiments, disposable baby bibs are used. In some embodiments, back straps secure the bib to the torso of the baby. Various accessories are disclosed to further achieve the objects of the invention such as pockets and tear-off attachments. Also, a fastening system is disclosed which prevents the baby from removing the bib.

In some embodiments of the present invention, a unique back panel affixed spill-catching pocket is disclosed. According to these embodiments, a pocket is affixed to the rear panel of a bib. The pocket is configured to turn inside-out from underneath the bib such that a pocket is created on the front panel of the bib. The resulting front pocket naturally bulges out from the front of the front panel, providing an effective pouch to catch spilled items. Furthermore, the corners and creases of the pouch are able to be easily and effectively cleaned when turned back to the back panel.

BRIEF DESCRIPTION OF THE DRAWINGS

The novel features of the invention are set forth in the appended claims. However, for the purpose of explanation, several embodiments of the invention are set forth in the following figures.

DETAILED DESCRIPTION

Figure 1A:
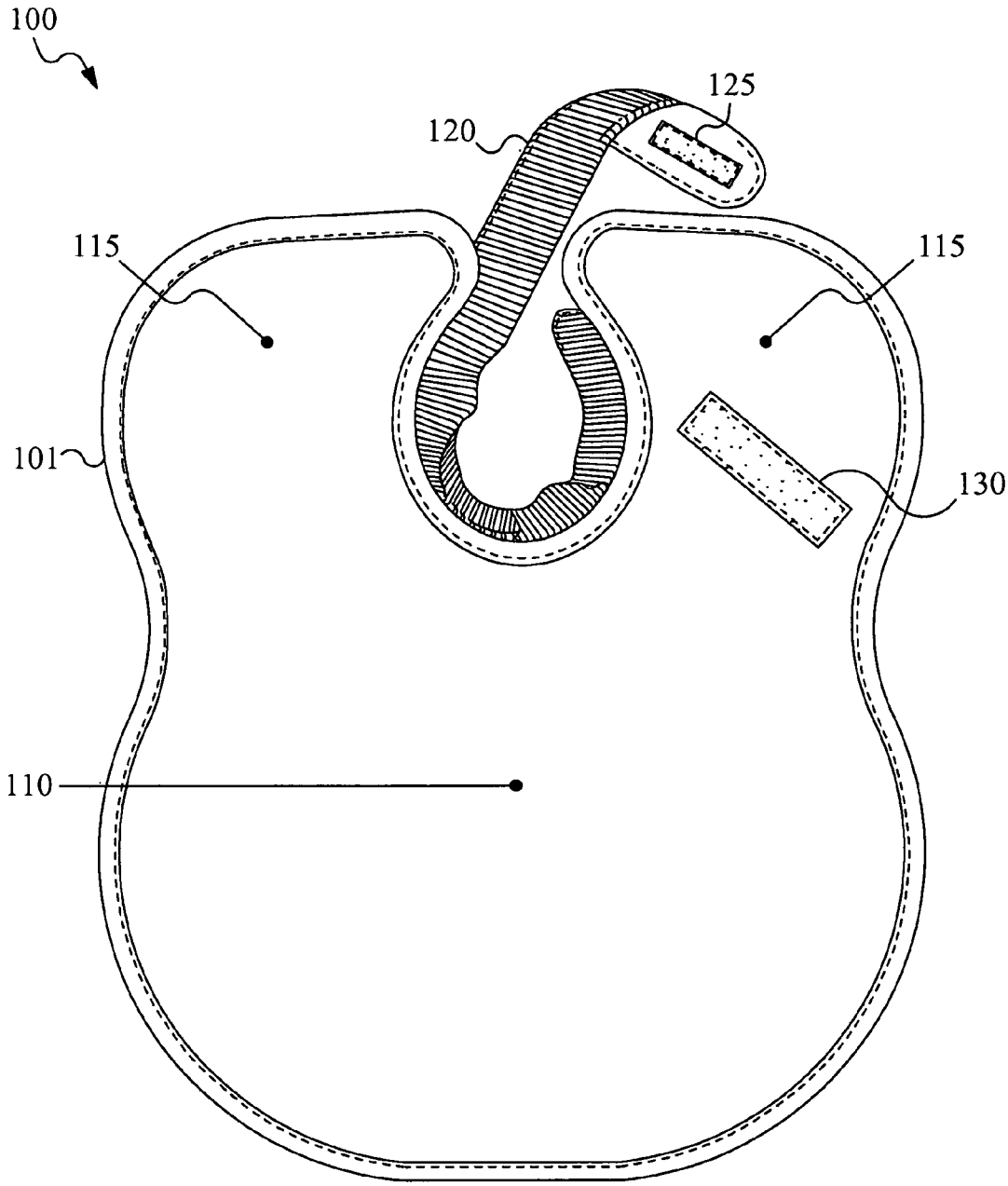
FIG. 1A is a front view of one embodiment of the baby bib according to the present invention with the strap unattached.

FIG. 1A shows the basic configuration of the baby bib 100 according to some embodiments of the present invention. A body portion 101 has a body protection panel 110 and shoulder straps 115. The body portion 101 is designed to ergonomically fit the bodies of babies. As shown, the baby bib according to this particular embodiment has an exemplary hourglass shape. However, it will be clear to one ordinarily skilled in the art that other shapes are also contemplated. The shoulder straps 115 are designed to extend over a baby's shoulders and around its neck, thus forming an enclosure around the baby's neck.

The multi-purpose neck strap 120 is shown in an open position. The multi-purpose neck strap is preferably an absorbent and soft material and is more than thick enough to cover a baby's neckline. At the end of the multi-purpose neck strap 120 is one side of a fastening means 125 (on the underside of the strap, shown as stitching). The corresponding fastening means is shown on the body 101 of the bib as a long fastening strip 130. The long fastening strip 130 allows the tightness of the multi-purpose neck strap 120 to adjust depending on the size of the baby's neck. The fastening means can include, but is not limited to the following embodiments: adhesives, buckles, buttons, clips, hook and loop fasteners such as Velcro, pins, snaps, straps, stitching, ties, zippers or the like. Preferably, the fastening means is a highly durable and strong hook and loop fastener. Using a highly durable hook and loop fastener helps prevent a child from removing the strap and also allows the bib to be laundered without the fastener becoming ineffective.

Figure 1B:
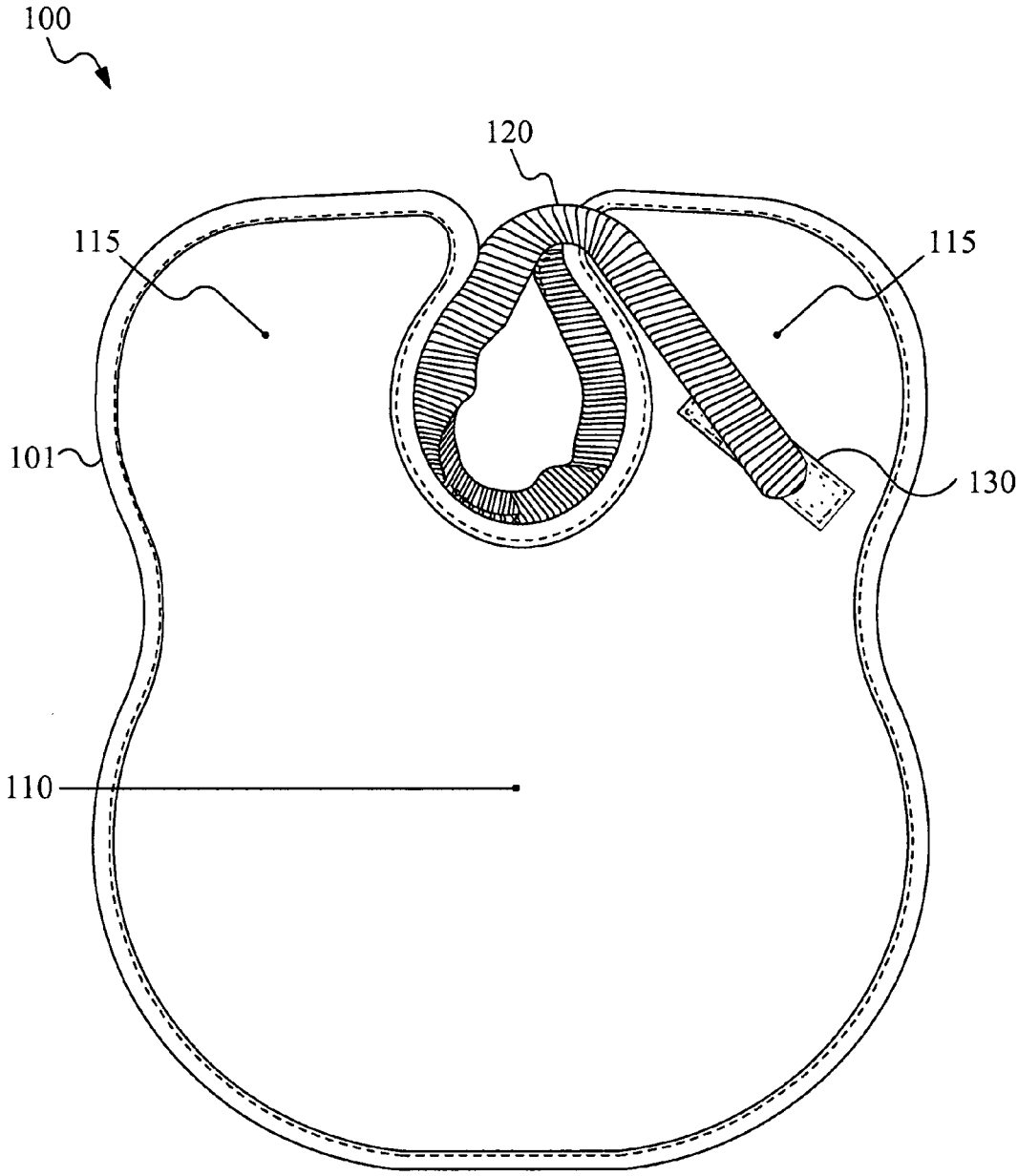
FIG. 1B is a front view of one embodiment of the baby bib according to the present invention with the strap attached.

FIG. 1B shows the baby bib 100 with the multi-purpose neck strap 120 in the closed position. The fastening means (not shown in FIG. 1B) is fastened on some portion of the long fastening strip 130. The multi-purpose neck strap 120 substantially encircles the baby's neck. Once the multi-purpose neck strap 120 is wrapped around a baby's neck and its tightness adjusted to be comfortable but also snug enough to prevent baby food from sliding down the baby's chin and neck, the fastening means is fastened on the fastening strip 130. Such a configuration achieves a number of important objects of the present invention.

First, the multi-purpose neck strap 120 provides a scrunch-neck barrier. Typical baby bibs provide a protective panel over the chest of a baby but do nothing to stop the baby's neck from getting wet and dirty. As stated above, the multi-purpose neck strap 120 covers the neck and supplies additional material into the neck area. This additional material can be adjusted, or "scrunched up" beneath the baby's chin before feeding. Any liquid spilled or drooled out of the baby's mouth will be absorbed in the scrunch-neck barrier. This feature provides the baby greater comfort, cleanliness and health.

Next, the multi-purpose neck strap 120 allows a caregiver to apply and remove the bib from the baby, without lifting the baby's head or jostling the baby. Typical bibs are put on by placing the bibs over the baby's head or by wrapping shoulder straps around the baby's neck and fastening the straps behind the baby's head. Babies very frequently fall asleep after a feeding and these typical bibs create a challenge to caregivers who want to the remove a bib from a sleeping baby after a feeding. Requiring the caregiver to pull the bib over the baby's head or lift the baby's head to unfasten the bib would risk waking and irritating the baby. The multi-purpose neck strap 120 of the present invention avoids this problems. Since the fastening means 125 is fastened on the fastening strip 130 on the front side of the bib 100, the caregiver can simply unfasten the strap and pull it forward from behind the baby's head.

Also, the multi-purpose neck strap 120 allows the bib 101 to be adjustable according to baby's neck size. Such a feature allows the bib 101 to be used for a longer period than traditional baby bibs which quickly become too small as the baby grows.

A number of washable and reusable materials can be used to construct the bib and to help achieve the objects of the present invention. In some embodiments, a highly absorbent material such as microfiber is used for the front of the body portion 101. In some embodiments a rib knit microfiber is used for the multi-purpose neck strap 120. In other embodiments, the front panel of the bib or the neck strap is constructed of a material selected from among: acrylic, cotton, flannel, linen, polyester, terrycloth, and wool. However, it will be readily apparent to those ordinarily skilled in the art that any other suitable material can be used to construct the bib. In addition to washable and reusable bibs, disposable scrunch-neck bibs are also conceived.

Figure 2:
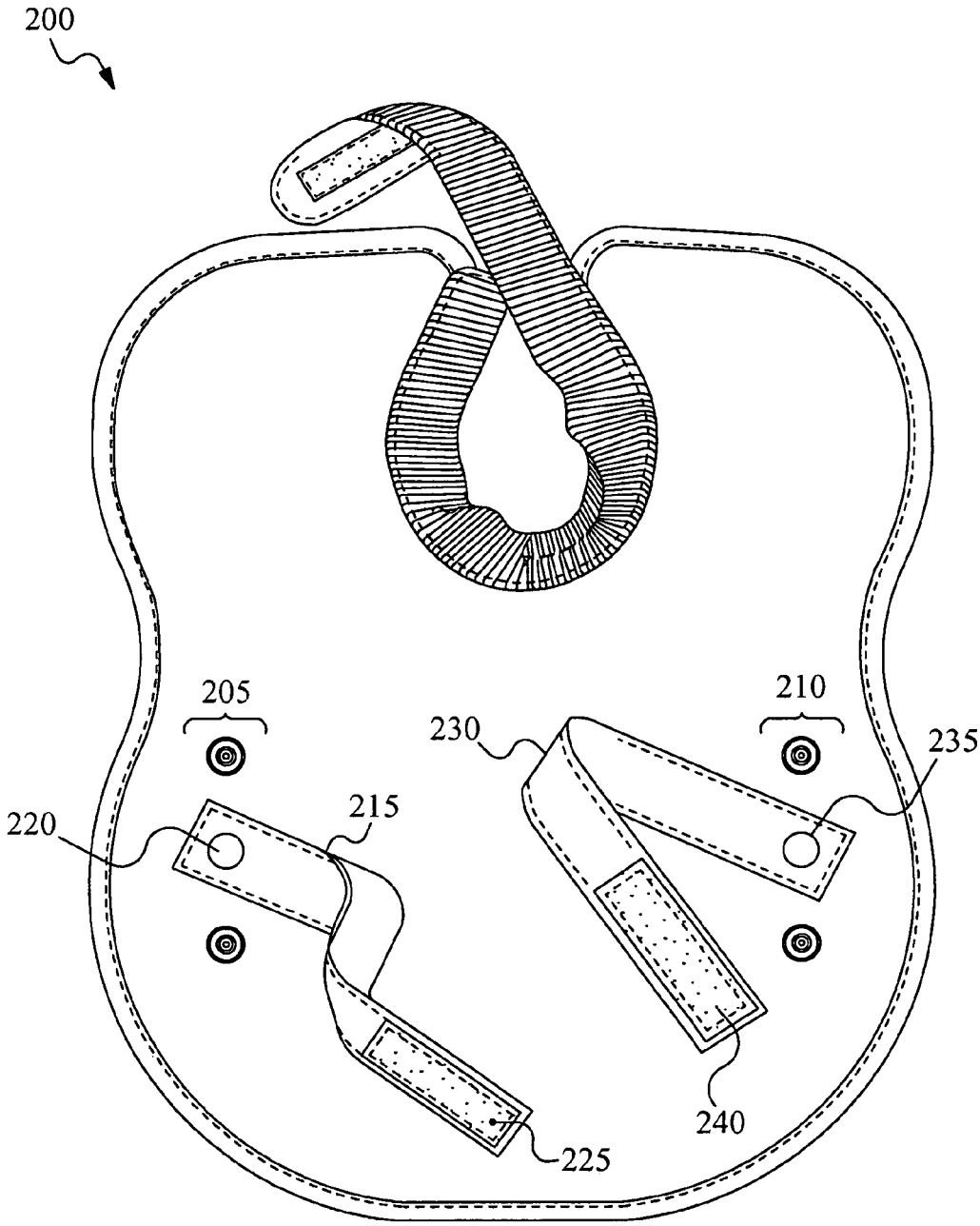
FIG. 2 is a back view of another embodiment of the baby bib according to the present invention.

FIG. 2 illustrates other inventive features of the present invention. FIG. 2 shows the back side of a scrunch-neck bib 200. On the back of the scrunch-neck bib 200 are two optional rows of fasteners 205, 210. Preferably, the fasteners 205 and 210 are durable, high quality snaps. Also included are two waist band straps 215, 230. On one end of the waist band strap 215 is a snap 220 which corresponds with the fasteners in row 205. On the other end of waist band strap 215 is another fastener 225, in this case the hooks in a hook and loop fastener. On one end of the waist band strap 230 is a snap 235 which corresponds with the fasteners in row 210. On the other end of waist band strap 230 is another fastener 240, in this case the loops in a hook and loop fastener.

The optional waist band straps 215 and 230 are used to secure the bib 200 to the body of a child. The fasteners 205 and 210 allow the waist band straps to be appropriately positioned around the waist of a child according to the child's height. The fasteners 225 and 235 allow the tightness of the bib to be adjusted around the child's body. The ease and scope of adjustment allows the bib of the present invention to be used with children of all ages and sizes and adequately protects the child's neckline in each case. Furthermore, the waist straps allows the child to move around and play while wearing a bib, without it getting in the child's way.

The back side of the scrunch-neck bib 200 can be made with a number of materials and configurations. Preferably, the back side of the scrunch-neck bib is made with a waterproof material or another material treated with a durable water repellant.

Figure 3:
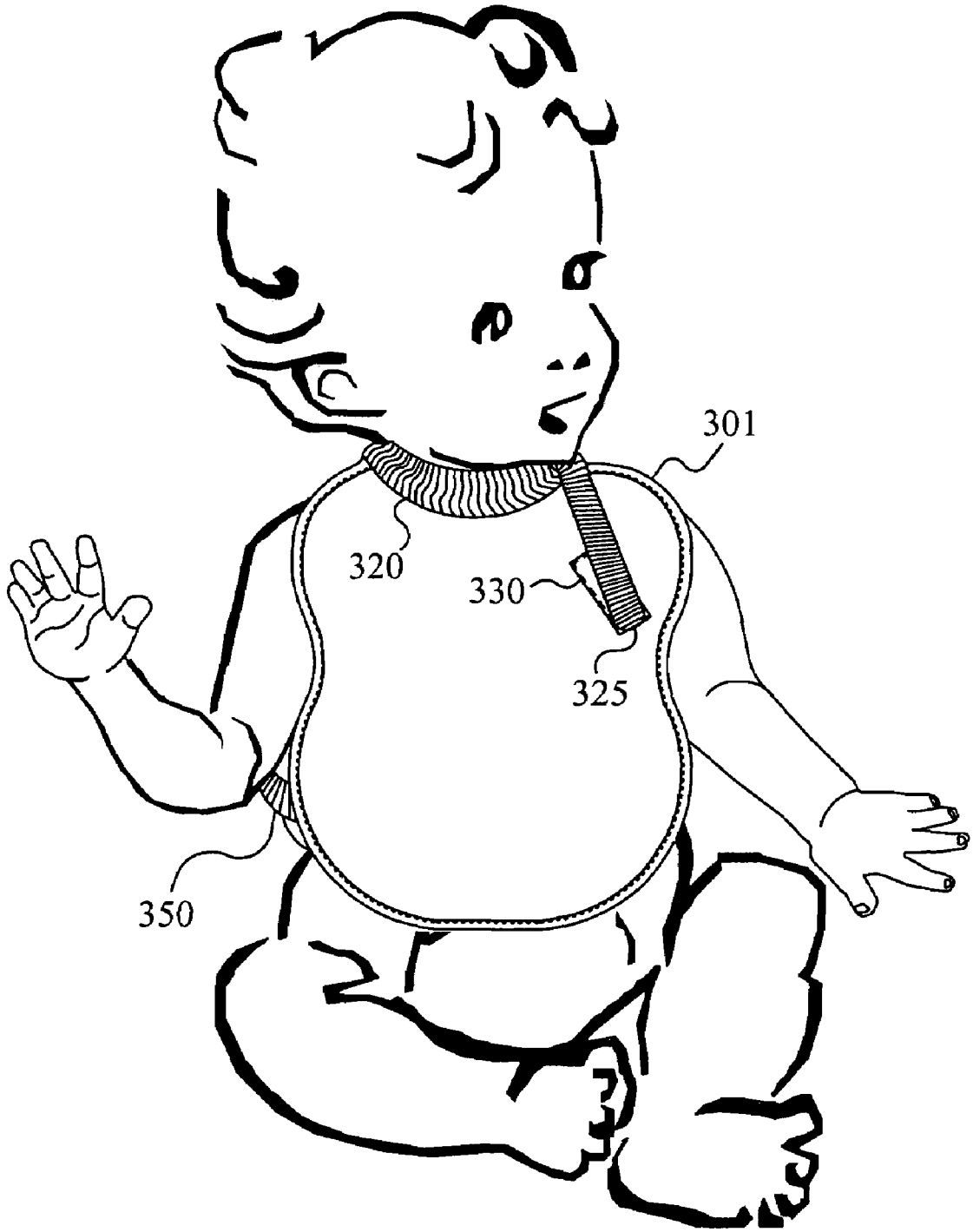
FIG. 3 shows the baby bib according to the present invention fitted on an infant, and illustrates its novel and useful features.

FIG. 3 shows the baby bib 300 according to the preferred embodiment of the present invention fitted on an infant. As shown, the bib 301 fits securely around the infant using the neck strap 320 and the waist band strap 350. The neck strap 330 fastens to fastener 325. Such a fastening means allows a caregiver to take off the bib 301 from the front. The bib 301 covers the infant's torso and shoulders and the neck strap 320 cover the infant's entire neck. Furthermore, the neck strap 320 contains additional material needed to cover the infant's neck. This additional material is scrunched up beneath the infant's chin. This ensures that liquid spilled out of the infant's mouth is absorbed by the neck strap before it has an opportunity to dribble down onto the infant's skin or clothes.

Figure 4A:
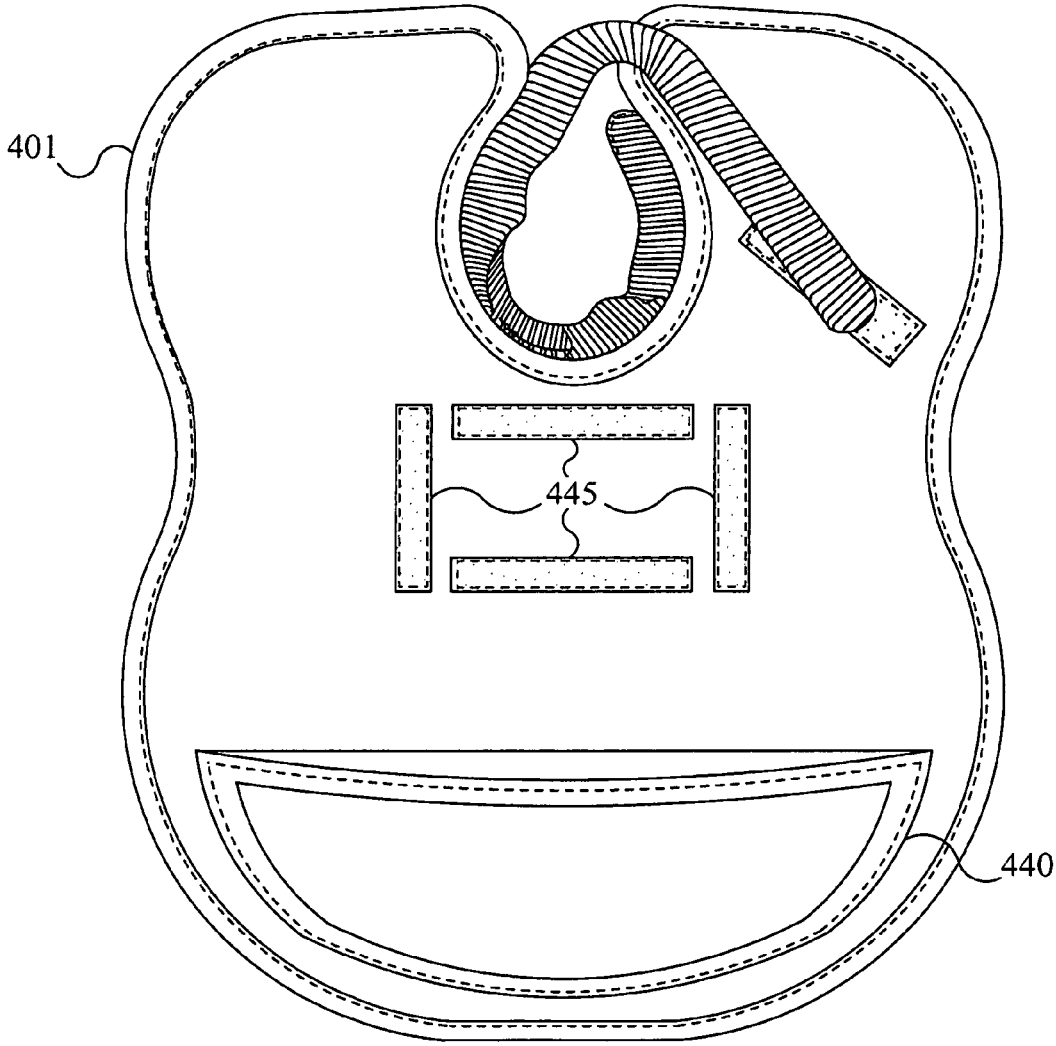
FIG. 4A illustrates the baby bib of the present invention with various accessories and accessory attachments.

In some embodiments of the invention, the baby bib with protective neckline has various accessories to further improve the objects of the invention. FIG. 4A illustrates the baby bib 401 of the present invention with a pocket 440 for catching food and with fasteners 445 for attaching a tear-off attachment (not shown).

Figure 4B:
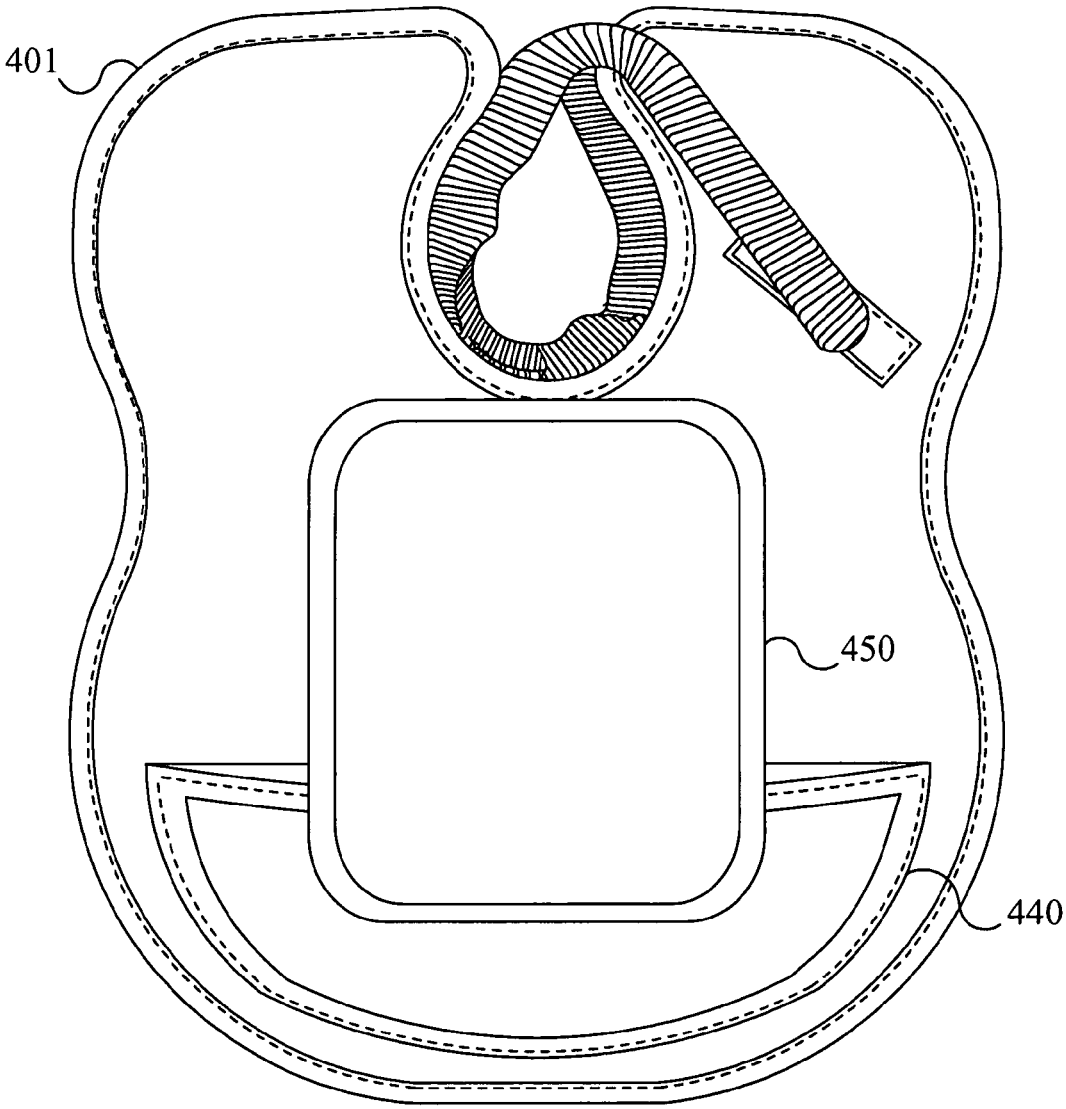
FIG. 4B illustrates the baby bib of the present invention with various accessories.

FIG. 4B shows the bib 401 with pocket 440 and with a tear-off attachment 450 attached. The tear-off attachment 450 is centrally located on the bib 401 to catch the majority of spilled food. In some embodiments of the present invention the tear-off attachment 450 is a bib cover which helps keeps the bib clean and dry. In some embodiments, the tear-off attachment 450 is a disposable material which serves as bib cover. Alternatively, the tear-off attachment 450 can also be laundered in standard washers and dryers. In some embodiments of the present invention, the tear-off attachment 450 is a pocket for catching spilled food. In some embodiments of the present invention, the tear-off attachment 450 is a cloth extension for wiping a baby's mouth or face. Although specific examples are given for the tear-off attachment 450, it will be apparent to those ordinarily skilled in the art that any appropriately sized attachment commonly associated with child feeding or, more generally, to child care can be used as the tear-off attachment 450.

Figure 5:
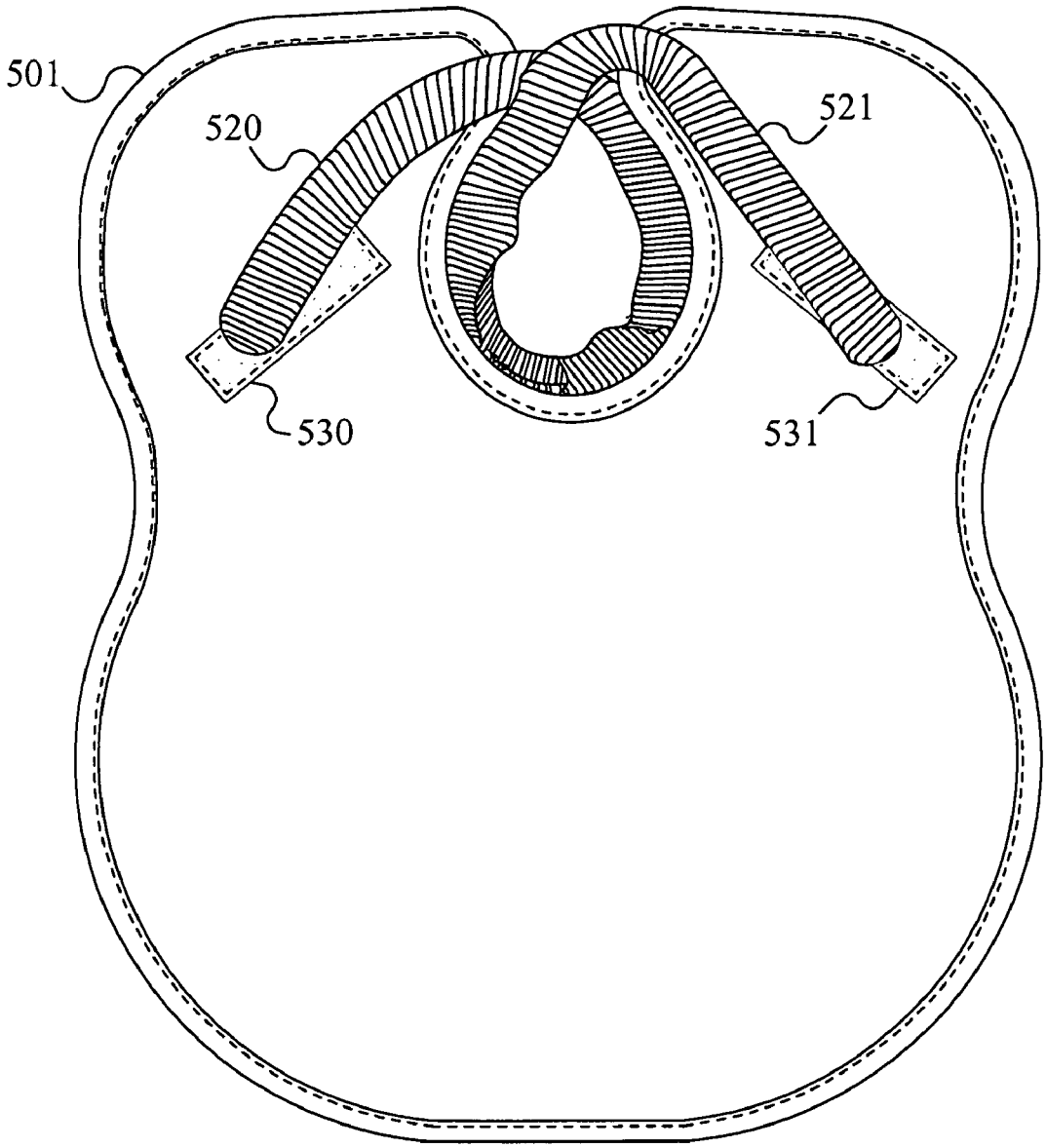
FIG. 5 illustrates yet another embodiment of the present invention with two straps to secure the bib around a baby's neck.

In some embodiments of the present invention, two straps are used to secure the bib around a baby's neck. FIG. 5 illustrates the baby bib 501 with two straps 520, 521 to secure the bib 501 around a baby's neck. In this embodiment, strap 520 is wrapped around the baby's neck and secured to fastener 530 and strap 521 is wrapped around the baby's neck and secured to fastener 531. In this embodiment, the bib 501 can be removed from the front of the baby by removing straps 520 and 521.

Figure 6A:
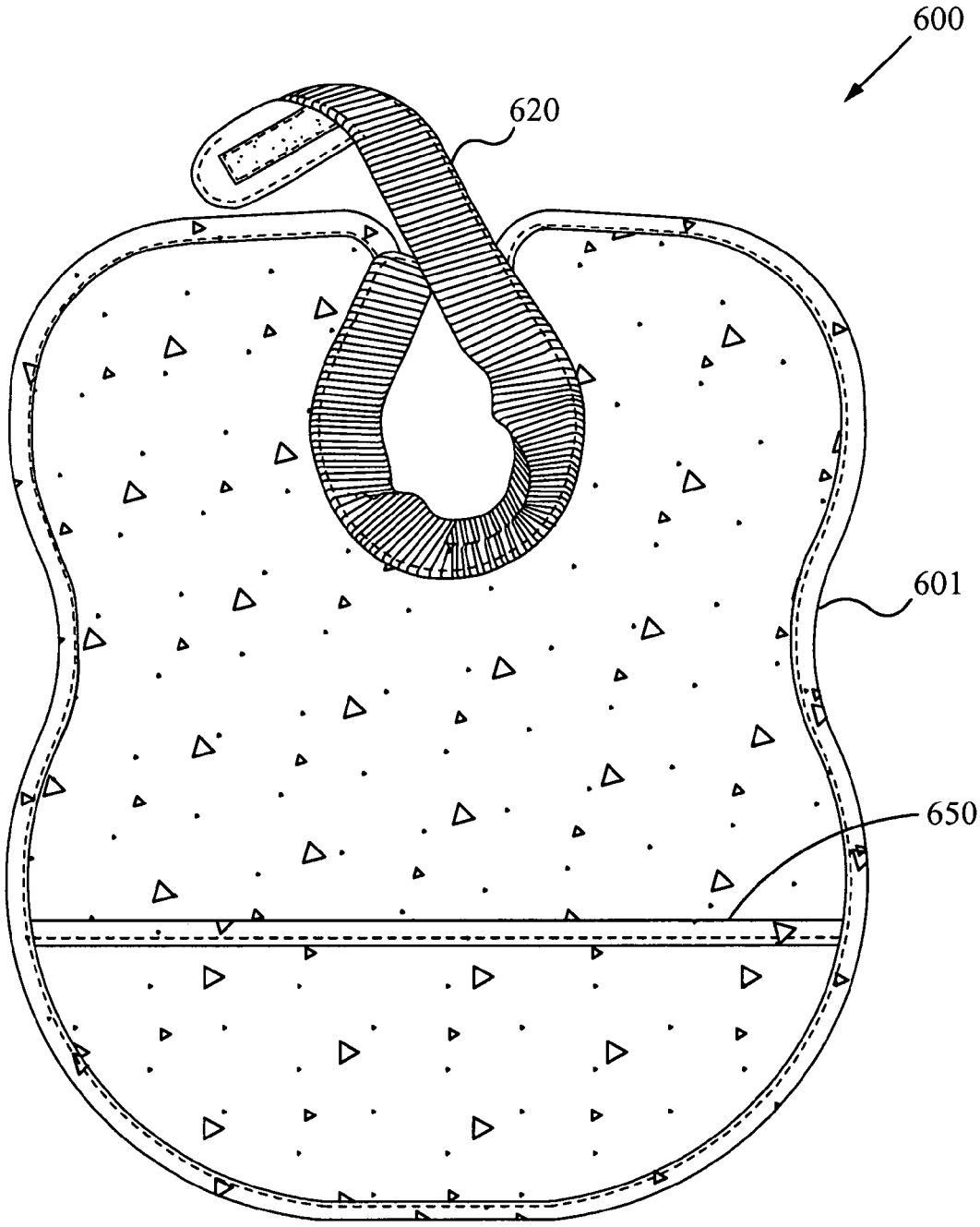
FIG. 6A is a back view of the baby bib with a rear-affixed pocket according to some embodiments of the present invention.

In some embodiments of the present invention, a unique spill-catching pocket is affixed to the rear panel of a bib. FIG. 6A illustrates a rear view of the baby bib 600 according to some embodiments of the present invention. The baby bib 600 comprises a body portion 601, a scrunch neck collar 620, including a scrunch neck strap (not shown) as explained above, and a rear-affixed pocket 650. In some embodiments of the present invention, the body portion 601 is comprised of a water proof and/or water resistant material. The rear-affixed pocket 650 is configured to turn inside-out from underneath the bib such that a pocket (not shown in FIG. 6A) is created on the front panel of the bib 600.

Figure 6B:
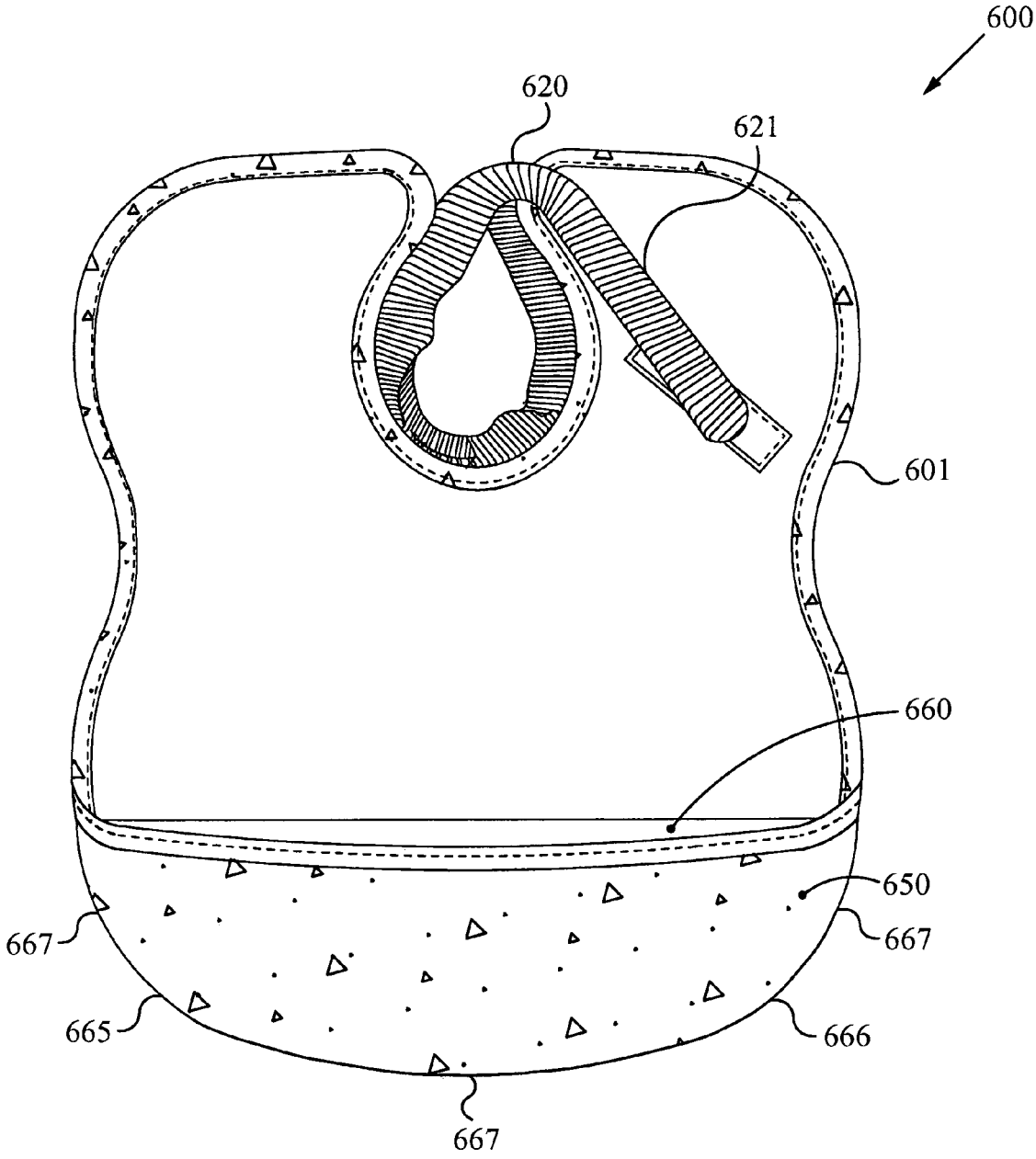
FIG. 6B is a front view of the baby bib with a rear-affixed pocket turned inside-out onto the front side of the bib according to some embodiments of the present invention.

FIG. 6B illustrates a front view of the baby bib 600 with a body portion 601, scrunch neck collar 620, strap 621 and with the rear-affixed pocket 650 turned inside-out resulting in the rear-affixed pocket 650 positioned on the front of the baby bib 600. In some embodiments of the present invention, the rear-affixed pocket 650 naturally bulges out from the front of the body portion 601, providing an effective pouch 660 to catch spilled items. Furthermore, the corners 665, 666 and seams 667 of the rear-affixed pocket 650 are able to be easily and effectively cleaned when turned back to the back panel of the body portion 601.

In some embodiments of the present invention, the front side of the body portion 601 and the back side of the body portion 601 are comprised of different materials. For example, in the preferred embodiment of the present invention, the front side of the body portion 601 is substantially comprised of a soft microfiber and the back side of the body portion 601 is comprised of a waterproof material (indicated with triangle pattern). According to this embodiment, the front side of the body portion 601 is soft enough to wipe a baby's skin and the back side is functionally water proof to keep a baby dry despite liquid spills onto the bib 600.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

What is claimed is:

1. A bib for protecting clothes and skin of a baby, the bib comprising:

a. a body section having a front side and a back side;

b. a neck opening; and c. a strap distinct from the body section, wherein a first portion of the strap is coupled along the neck opening and a second portion of the strap is configured to wrap around the back of a neck and fasten to the front side of the body, further wherein the strap has additional material to form a scrunch-neck collar around the neck.

2. The bib for protecting clothes and skin of a baby according to claim 1, the bib further comprising:

a. a rear-affixed pocket coupled to the back side of the body section, wherein the rear-affixed pocket is configured to turn inside-out onto the front side of the body section, forming a front pouch, wherein the front pouch is configured to catch spilled articles.

3. The bib for protecting clothes and skin of a baby according to claim 2, wherein the rear-affixed pocket is configured such that the front pouch naturally bulges out away from the front side of the body section when the rear-affixed pocket is turned inside-out.

4. The bib for protecting clothes and skin of a baby according to claim 2, wherein the rear-affixed pocket is configured such that spilled articles caught in the front pouch are exposed when the rear-affixed pocket is returned to its back side of the body section position.

5. The bib for protecting clothes and skin of a baby according to claim 1, wherein the front side of the body section is microfiber.

6. The bib for protecting clothes and skin of a baby according to claim 1, wherein the back side of the body section is a waterproof material.

7. The bib for protecting clothes and skin of a baby according to claim 1, wherein the strap is an absorbent rib knit microfiber.

8. The bib for protecting clothes and skin of a baby according to claim 1, wherein the strap is a waterproof material.

9. The bib for protecting clothes and skin of a baby according to claim 1, wherein the strap at least completely covers a neckline when the strap is wrapped around the neck and wherein excess material is scrunched up and form-fits against the neckline.

10. The bib for protecting clothes and skin of a baby according to claim 1, wherein a width of the strap ranges from 1 inch to 1.5 inches.

11. The bib for protecting clothes and skin of a baby according to claim 1, wherein a fastening mechanism comprises one side of a hook and loop fastener on the second portion of the strap and a corresponding side of the hook and loop fastener on the body section.

12. The bib for protecting clothes and skin of a baby according to claim 11, wherein the hook and loop fasteners are configured to allow a circumference of the scrunch-neck collar to be adjustable.

13. The bib for protecting clothes and skin of a baby according to claim 1, wherein the bib is capable of being laundered in a standard washing machine and a standard dryer without damage to the bib.

14. A bib comprising:

a. a body having a pocket coupled to a first side of the body; and b. a strap distinct from the body, wherein a first portion of the strap is coupled along a neck opening and a second portion of the strap is configured to wrap around the back of a neck and fasten to a second side of the body further wherein the strap has additional material to form a scrunch-neck collar around the neck.

15. The bib according to claim 14, wherein the scrunch-neck collar is made from absorbent material.

16. The bib according to claim 14, wherein the strap is adjustable.

17. The bib according to claim 14, wherein the pocket is configured to turn inside-out onto the second side of the body, forming a pouch.

18. The bib according to claim 17, wherein the pouch naturally bulges out away from the second side of the body when the pocket is turned inside-out.

19. The bib according to claim 17, wherein spilled articles caught in the pouch are exposed when the pocket is returned to the first side of the body position.

20. A bib having a protective neckline comprising:

a. a body having a pocket coupled to a first side of the body, wherein the pocket is configured to turn inside-out onto a second side of the body, forming a pouch that naturally bulges out away from the second side of the body when the pocket is turned inside-out; and b. a strap distinct from the body, wherein a first portion of the strap is coupled along a neck opening and a second portion of the strap is configured to wrap around the back of a neck and fasten to the second side of the body, further wherein the strap has additional material to form a scrunch-neck collar around the neck.

* * * * *